US011992137B2

(12) United States Patent
Torsvik

(10) Patent No.: US 11,992,137 B2
(45) Date of Patent: May 28, 2024

(54) SEPARATOR DEVICE FOR A CUP

(71) Applicant: Nova-Invest AS, Mandal (NO)

(72) Inventor: Ole Kristoffer Torsvik, Lindesnes (NO)

(73) Assignee: NOVA-INVEST AS, Mandal (NO)

( * ) Notice: Subject to any disclaimer, the term of this patent is extended or adjusted under 35 U.S.C. 154(b) by 541 days.

(21) Appl. No.: 17/085,771

(22) Filed: Oct. 30, 2020

(65) Prior Publication Data

US 2021/0127870 A1 May 6, 2021

Related U.S. Application Data

(60) Provisional application No. 62/929,442, filed on Nov. 1, 2019.

(51) Int. Cl.
*A47G 19/22* (2006.01)
*A47G 19/12* (2006.01)

(52) U.S. Cl.
CPC ..... *A47G 19/12* (2013.01); *A47G 19/2205* (2013.01); *A47G 2019/122* (2013.01)

(58) Field of Classification Search
CPC ..... A47J 31/005; A47J 31/08; A47J 31/20; B65D 2543/0046; B65D 47/06; B65D 85/8061; A47G 19/12; A47G 19/2205; A47G 19/2211; A47G 19/2266; A47G 19/2272; A47G 19/14
USPC ..... 206/0.5, 217, 219; 220/719, 501, 713, 220/529
See application file for complete search history.

(56) References Cited

U.S. PATENT DOCUMENTS 962,641 A * 6/1910 Kaupmann ..... B65D 1/265 220/703
2,170,311 A * 8/1939 Smith ..... A47G 19/02 220/575
5,367,946 A * 11/1994 Yasunaga ..... A47G 19/2266 220/555
5,803,316 A * 9/1998 Couture ..... A47G 19/12 222/189.06

* cited by examiner

*Primary Examiner* — King M Chu
(74) *Attorney, Agent, or Firm* — Wenderoth, Lind & Ponack, L.L.P.

(57) ABSTRACT

The present invention relates to a new separator device (30) and a new cup (10) comprising a separator device, wherein the separator device (30) and the cup (10) with the separator device are configured for separation of at least one undesired and/or unhealthy drink substance, such as, but not limited to, e.g. coffee fat, diterpenes, cafestol and kahweol.

20 Claims, 10 Drawing Sheets

SEPARATOR DEVICE FOR A CUP

TECHNICAL FIELD

The present invention relates to products configured for separating, from the drink itself, at least one undesired and/or unhealthy drink substance, such as, but not limited to, e.g. a coffee fat. Thus, the present invention relates to e.g. a separator device for a cup and/or a cup having a separator device.

BACKGROUND OF THE INVENTION

Epidemiologic and mechanistic studies have revealed and reported that "diterpenes", "cafestol", and to a lesser extent "kahweol", that are naturally found in coffee oil or fat and in unfiltered coffees, can alter lipid enzymes and thus influence cholesterol levels in a human body. This relationship was found to be linear with increasing "cafestol" consumption (according to Urgert and Katan, 1997). A meta-analysis of a set of 18 clinical intervention trials on coffee consumption and cholesterol and serum lipids was performed in 2001 by Jee, et al. The authors corroborated the dose-response relationship between coffee consumption and cholesterol and observed a strong increase upon the consumption of six (-6-) or more cups of boiled coffee per day, which was not observed when a paper filter was used. Thus drinking unfiltered coffee can have cholesterol-raising effects in the human body due to the "diterpenes". It is however known that the cholesterol-elevating effect of boiled-type coffee disappears when the liquid is poured through a paper filter before consumption, because the lipid(s) from the coffee fat is(are) retained in the paper filter.

Therefore, there is a need for finding other ways of isolating or separating the coffee fat from the coffee liquid to be consumed, than just using paper filters.

SUMMARY OF THE INVENTION

It is thus an object of the invention to provide another way for isolating or separating at least one undesired and/or unhealthy drink substance from the drink or liquid to be consumed by a person or a user.

Another object of the invention is to provide an alternative to paper filters that are used in filtering hot or warm coffee drinks.

According to an aspect of the invention, this is achieved with a new separator device configured for a cup.

According to another aspect of the invention, this is achieved with a new cup comprising a separator device.

The main features of the present invention are given in the independent claims, and additional features of the invention are given in the dependent claims.

The present invention teaches a new separator device that is configured for separation, from the drink itself, of at least one undesired and/or unhealthy drink substance, which can for example be chosen from the group consisting of: coffee fat, diterpenes, cafestol and/or kahweol. The separator device comprises an elongated structure having two end sides. The elongated structure is arranged with a canal allowing for a liquid to pass therethrough. A bottom end side of the separator device is configured to be passed through an opening of a standard cover for a cup. A top end side of the separator device is fittable onto the cover, so that a surface of the top end side of the separator device, that is facing a surface of the cover, is fittable with a predetermined area of this cover surface that is around the opening of the cover.

Both previously mentioned surfaces are mateable with each other curves in such a way that, when fitted together, the cover and the separator device are firmly but detachably connected. The elongated structure of the separator device has a predetermined length being adapted to the length of the cup in such a manner that, when the top end side of the separator device is fitted onto the cover, the bottom end side of the separator device is in the proximity of the bottom of the cup.

The elongated structure can be bent or curved in at least one predetermined area in order to follow the form/shape of an inner surface of a side wall of the cup.

The separator device can be made of a disposable material. Alternatively, the separator device can be made of a non-disposable material.

The top end side of the separator can be configured to be pressed or snapped onto the cover.

The separator and the cover for the cup can be made together and/or constituted as one element which can be sufficiently rigid.

The upper surface of the top end side of the separator device is configured as a drinking area suitable for a user to drink therefrom.

The separator device further comprises a filter arrangement. The filter arrangement can be arranged at least one of: in the canal of the elongated structure and/or at one end side of the elongated structure.

The present invention teaches also a new cup configured for separation of at least one undesired and/or unhealthy drink substance, which can for example be chosen from the group consisting of: coffee fat, diterpenes, cafestol and/or kahweol. The cup comprises a bottom side, an open top side and a side wall. An inner wall is arranged within the cup thus providing within the cup a drink containing compartment and a drinking compartment. The drinking compartment comprises a drinking area defined at the open top side of the cup. The drinking compartment is arranged adjacent to a certain part of a top edge of a side wall of the cup in order to be suitable for a user to drink therefrom. The drink containing compartment has access to some part of the open top side in order to allow pouring a drink into the cup. A liquid or fluid communicating area is arranged in the inner wall for connecting the two compartments together in such a manner that said at least one undesired and/or unhealthy drink substance is being kept in the drink containing compartment and is not allowed to enter into the drinking compartment.

The liquid or fluid communicating area can be arranged in the proximity of the bottom side area of the cup.

The liquid communicating area can be at least one inlet. Alternatively, the liquid communicating area can be at least one opening.

At least a predetermined part of the inner wall constitutes a respective predetermined part of the inner side of the side wall. A respective predetermined part of the drinking compartment is a channel or chamber integrated in the side wall.

The drinking area can be broader or wider than the rest of the drinking compartment.

In another embodiment, the liquid communicating area can be a filter arrangement.

The filter arrangement can comprise an impermeable part and a filtering part. The filtering part can be arranged in the proximity of the bottom side area of the cup.

The filter arrangement can be replaceable and square-shaped. The filter arrangement can further comprise, on each of its two mainly vertical sides, a rail, or respectively a slot, in order to be able to cooperate or mate with and also slide along a corresponding slot, or respectively a rail, on each mainly vertical side of the inner wall. The replaceable filter arrangement can further be configured to be slidably replaced from the top side of the cup.

The filter arrangement can be replaceable and can further be configured to be pressed or snapped onto a predetermined area of the inner wall.

Said at least one undesired and/or unhealthy drink substance to be separated by the separator device can be, but is not limited to, at least one of: coffee fat, diterpenes, cafestol and kahweol.

BRIEF DESCRIPTION OF THE DRAWINGS

These and other aspects of the invention are apparent from and will be further elucidated, by way of examples, with reference to the drawings, wherein.

DETAILED DESCRIPTION OF THE EMBODIMENTS

Figure 1:
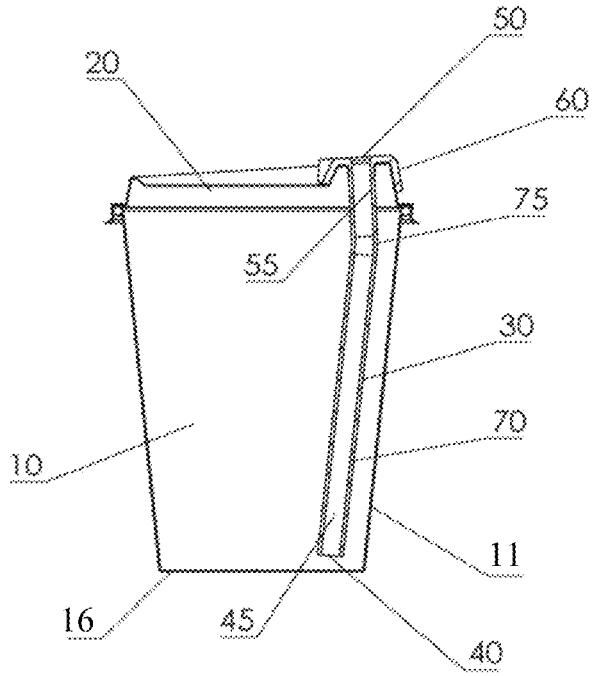
FIG. 1 shows a cross-sectional cut view of a separator device according to the present invention and adapted for a cup.

FIG. 1 (a cross-sectional cut view) illustrates a separator device 30 configured for separating undesired and/or unhealthy drink substance(s) from the drink itself. The separator device 30 according to the present invention is configured to be fit on a cover 20 for a cup 10, such as, but not limited to, a take-away cup. The separator device 30 has an elongated structure 55, 75, 70 with two end sides 40, 60. The elongated structure 55, 75, 70 of the separator device 30 can be constituted of at least three parts: a bottom elongated structure 70, a top elongated structure 55 and a predetermined curved area 75 therebetween. The elongated structure 55, 75, 70 of the separator device 30 is hollow, i.e. is supplied with a canal or duct 45. The separator device 30 is configured to be threaded, from an open bottom end side 40 thereof (i.e. the bottom end side of the bottom elongated structure 70), through an opening 50 of the cover 20 for the cup 10. The bottom end side 40 of the bottom elongated structure 70 has an opening thus constituting the bottom end of the canal or duct 45. The elongated structure 55, 75, 70 has a certain predetermined length adapted to the length of the cup 10 in such a manner that when a top end side 60 of the separator device 30 is fitted on or onto the cover 20 then the bottom end side 40 of the separator device 30 is in the proximity of the bottom 16 of the cup 10. The inner or lower surface of the top end side 60 of the separator device 30, that is facing the outer or upper surface of the cover 20, is configured to fit with a certain area of the outer or upper surface of the cover 20. This certain area is located near the top edge of the cup's 10 side wall and around the opening 50 of the cover 20. The inner or lower surface of the top end side 60 of the separator device 30 is further configured to follow or cooperate or mate with the curves of the outer or upper surface of the cover 20 in such a way that, when fitted or set together, the cover 20 and the separator device 30 will be firmly but detachably connected, i.e. shall act as one rigid body although they are two separate elements. Alternatively, the cover or lid 20 for the cup 10 and the separator device 30 can be made as one element. The elongated structure 55, 75, 70 can be bent or curved 75 in a certain or predetermined area 75 of the separator device 30 in order to follow the form or design of the inner surface of the side wall 11 of the cup 10, since the separator device 30 is to be arranged near the inner surface of the side wall 11 of the cup 10, due to the fact that the top end side 60 of the separator device 30 should be near the top edge of the side wall 11 of the cup 10. The top side of the top elongated structure 55 ends or terminates in the top end side 60 of the separator device 30, wherein there is another opening constituting the open top end of the canal or duct 45. The separator device 30 can be made of a disposable material, such as, but not limited to, rigid or hard paper, or cardboard, or certain plastics. Alternatively, the separator device 30 can be made of a non-disposable material, such as, but not limited to, metal(s), or alloy(s), or some plastics. The same alternative embodiments can be specified for at least one of: the cup 10 and the cover 20. In an embodiment, the cross-section of the bottom end side 40 of the separator device 30 can be visibly less than the cross-section of the opening 50 in the cover 20. In another embodiment, the cross-section of the bottom end side 40 of the separator device 30 can be invisibly less (e.g. only micro-metres or microns) than the cross-section of the opening 50 in the cover 20. The outer or upper surface of the top end side 60 of the separator device 30 can be configured as a drinking area that should be suitable for a user or a person to drink therefrom. The open top end side 60 of separator device 30 can thus be designed to ease the drinking by the user and to be suitable for the user's lips.

Figure 2:
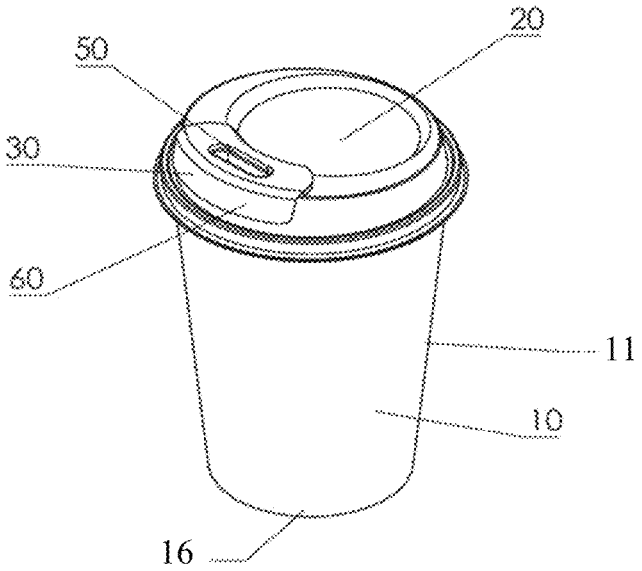
FIG. 2 illustrates in perspective how the separator device according to the present invention is fitted on a cover or lid of the cup.

FIG. 2 (a perspective view) shows the separator device 30 according to the present invention in perspective, wherein it is better visualized how the inner or lower surface of the top end side 60 of the separator 30 fits with the predetermined area of the outer or upper surface of the cover 20, where the predetermined area is around the opening 50 of the cover 20, so that all the curves and forms of the hole's 50 area of the cover 20 and the top end side area 60 of the separator device 30 cooperate with each other. It is also illustrated how the drinking area is arranged near the top edge of the cup's 10 side wall in order to be suitable for a user or a person to drink therefrom.

The separator device 30 can further comprise a filter arrangement 35. The filter arrangement 35 can be arranged at least one of: at a predetermined place in the canal or duct 45 of the elongated structure 55, 75, 70 and/or at least at one end side 40 and/or 60 (see opening 50) of the elongated structure 55, 75, 70. In one embodiment the filter arrangement 35 can be replaceable. The replaceable filter arrangement 35 can be, in this case, arranged at the bottom end side 40 of the elongated structure 55, 75, 70 and/or on top of the opening 50 at the top end side 60 of the elongated structure 55, 75, 70.

The designs and constructions of the separator device 30 are such that a successful separation of at least one undesired and/or unhealthy drink substance, such as, but not limited to, e.g. coffee fat, diterpenes, cafestol and kahweol, will be achieved.

Figure 3A:
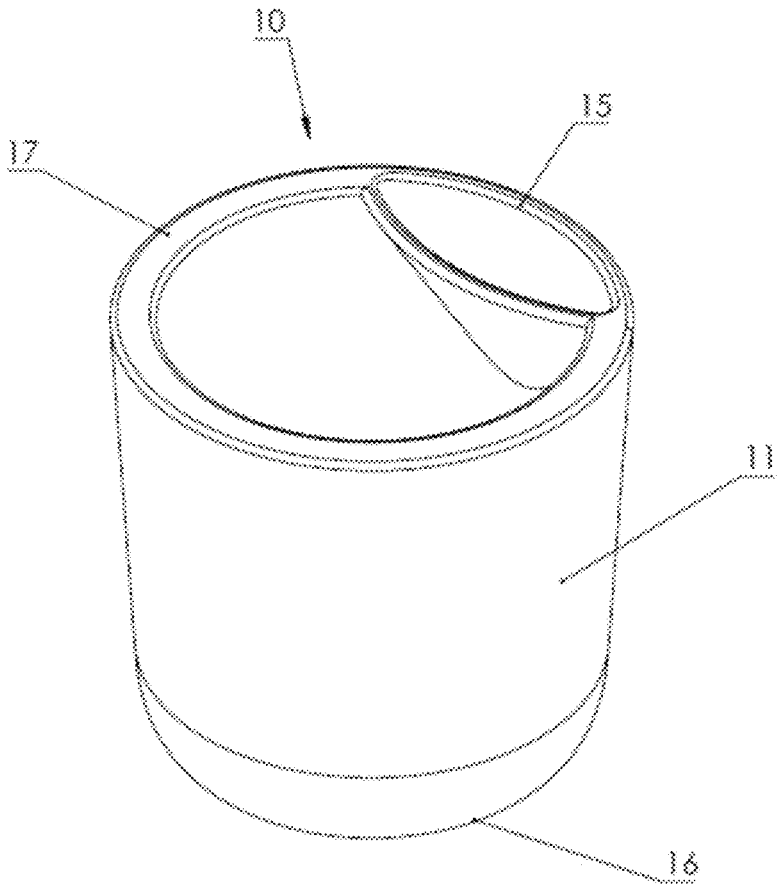
FIGS. 3A-3B show a first embodiment of a cup according to the present invention.
Figure 3B:
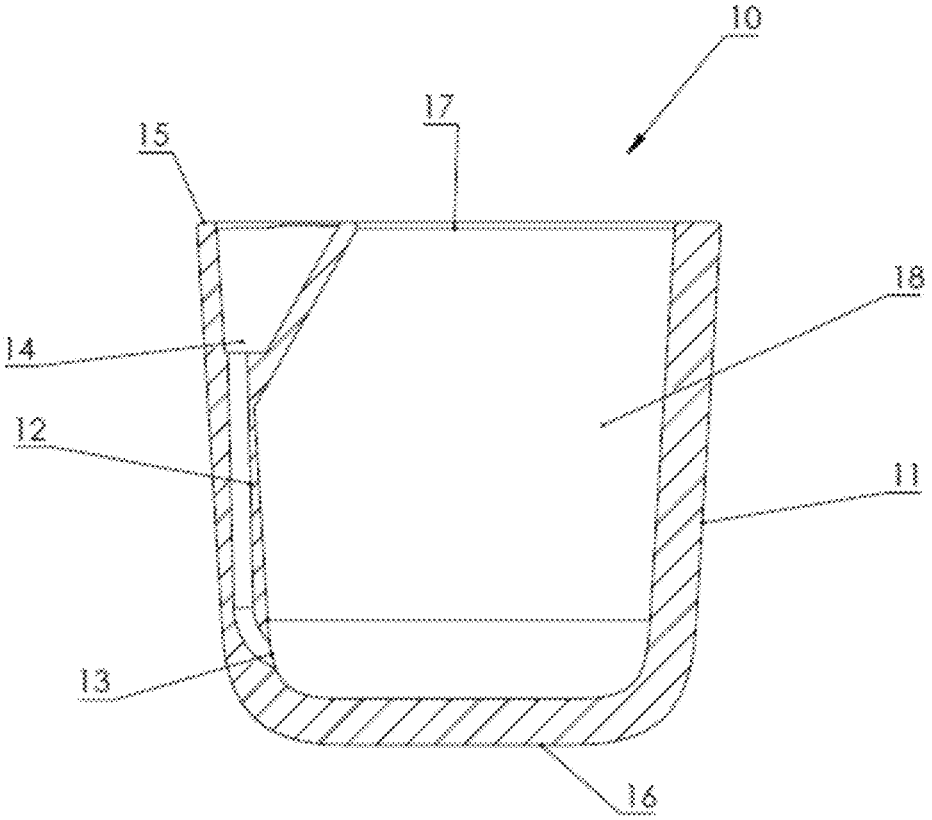

FIGS. 3A (a 3D/perspective view) and 3B (a cross-sectional cut view) illustrate a first embodiment of a cup 10 according to the present invention.

The cup 10 comprises a bottom side 16 and an open top side 17 and a side wall 11. The cup 10 further comprises a coffee-pouring or drink containing compartment 18 and a drinking compartment 14 separated by an inner wall 12. The two compartments 14, 18 are fluid or liquid communicating with each other or connected together through a determined area 13 in or of the inner wall 12. The drinking compartment 14, and particularly its drinking area 15, is arranged to have access to at least a part of the top edge of the cup's 10 side wall 11 in order to allow a person ora user to drink from the cup 10. Optionally, the drinking compartment 14 can have access to a part of the open top side 17 of the cup 10. The drink containing compartment 18 is arranged to have access to some part of the open top side 17 in order to allow for pouring the drink into the cup 10. Optionally, the drink containing compartment 18 can have access to the rest of the side wall 11 top edge of the cup 10.

In a first embodiment of the cup 10 the drinking compartment 14 is partially (i.e. in a certain or predetermined area) a channel or chamber having at least one inlet or opening 13 (see e.g. FIGS. 4C and 4D) that can be arranged near the bottom side 16 area of the cup 10. Said at least one inlet or opening 13 can alternatively be arranged ata different place of the inner wall 12, such as, for example, but not limited to, approximately middle height of the inner wall 12. The drinking compartment 14 at the top side 17 of the cup 10 is broader or wider than the partial channel or chamber and defines a drinking area 15 at a certain part of the top edge of the side wall 11 of the cup 10. Here the channel or chamber 14 is at least partially (i.e. in a certain or predetermined area) integrated in the side wall 11, and thus the inner wall 12 constitutes at least partially (i.e. in a certain or predetermined area) the inner side of the outer side wall 11.

The present invention also teaches a cup adapted for separation of at least one undesired or unhealthy drink substance, which can be chosen from the group consisting of: coffee fat, diterpenes, cafestol and/or kahweol, the cup comprising a bottom side 16, an open top side 17 and an outer side wall 11, wherein an inner wall 12 is arranged within the cup 10 providing within the cup 10 a drink containing compartment 18 and a drinking compartment 14, wherein the drinking compartment 14 comprises a drinking area 15 defined at the top side 17 of the cup 10, the drinking area 15 being configured for drinking therefrom, wherein the drink containing compartment 18 is configured for pouring therein a liquid to be consumed, such as for example hot or warm coffee, and wherein a fluid or liquid communicating area 13 is arranged in the inner wall 12 for connecting the two compartments 14, 18 in order to provide for separation of said at least one undesired or unhealthy drink substance.

The present invention also teaches a cup adapted for separation of at least one undesired or unhealthy drink substance, which can be chosen from the group consisting of: coffee fat, diterpenes, cafestol and/or kahweol, the cup comprising a bottom side 16, an open top side 17 and an outer side wall 11, wherein an inner wall 12 is arranged within the cup 10 providing within the cup 10 a drink containing compartment 18 and a drinking compartment 14, wherein the drinking compartment 14 comprises a drinking area 15 defined at the top side 17 of the cup 10, the drinking area 15 being configured for drinking therefrom, wherein the drink containing compartment 18 is also a liquid-pouring compartment 18 for a liquid to be consumed, such as for example hot or warm coffee, and wherein a fluid or liquid communicating area 13 is arranged in the inner wall 12 for connecting the two compartments 14, 18 in order to provide for separation of said at least one undesired or unhealthy drink substance.

The present invention also provides a cup adapted for separation of at least one undesired or unhealthy drink substance, which can be chosen from the group consisting of: coffee fat, diterpenes, cafestol and/or kahweol, the cup comprising a bottom side 16, an open top side 17 and an outer side wall 11, wherein an inner wall 12 is arranged within the cup 10 providing within the cup 10 a drink containing compartment 18 and a drinking compartment 14, wherein the drinking compartment 14 comprises a drinking area 15 defined at the top side 17 of the cup 10, the drinking area 15 being arranged for a user to drink therefrom, wherein the drink containing compartment 18 is arranged for pouring a drink, such as for example coffee, into the cup 10, and wherein a fluid or liquid communicating area 13 is arranged in the inner wall 12 for connecting the two compartments 14, 18 in order to provide for separation of said at least one undesired or unhealthy drink substance.

Figure 4A:
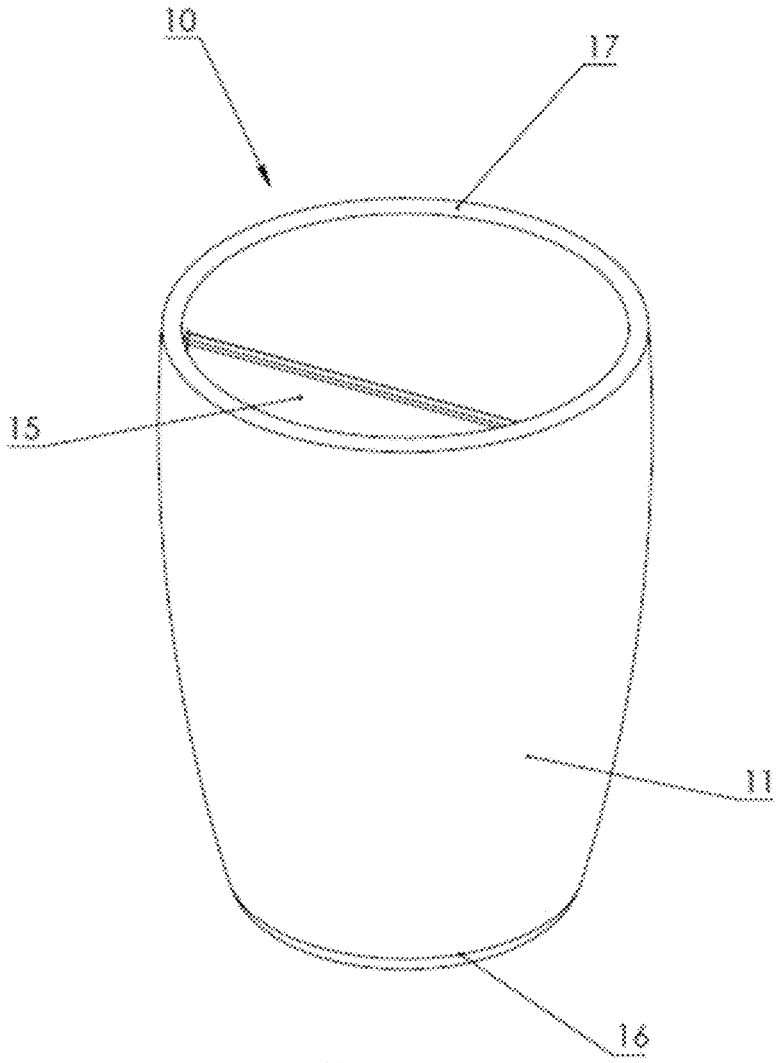
FIGS. 4A-4B illustrate a second embodiment of a cup according to the invention.
Figure 4B:
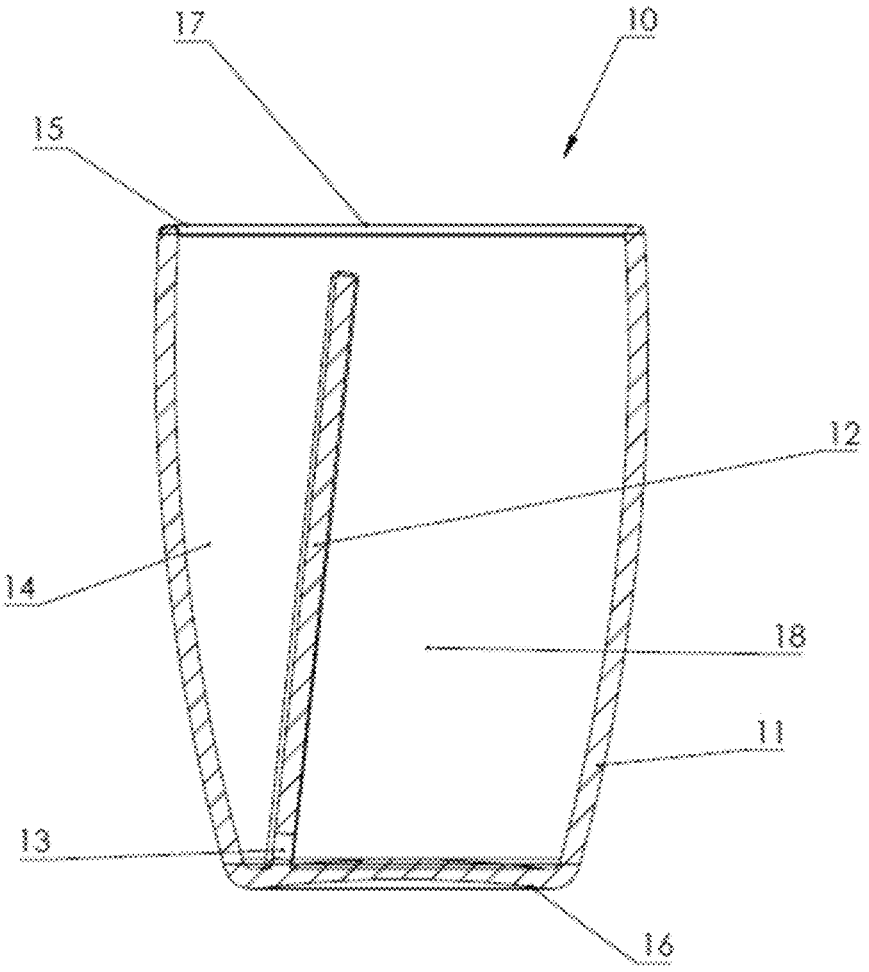
Figure 4C:
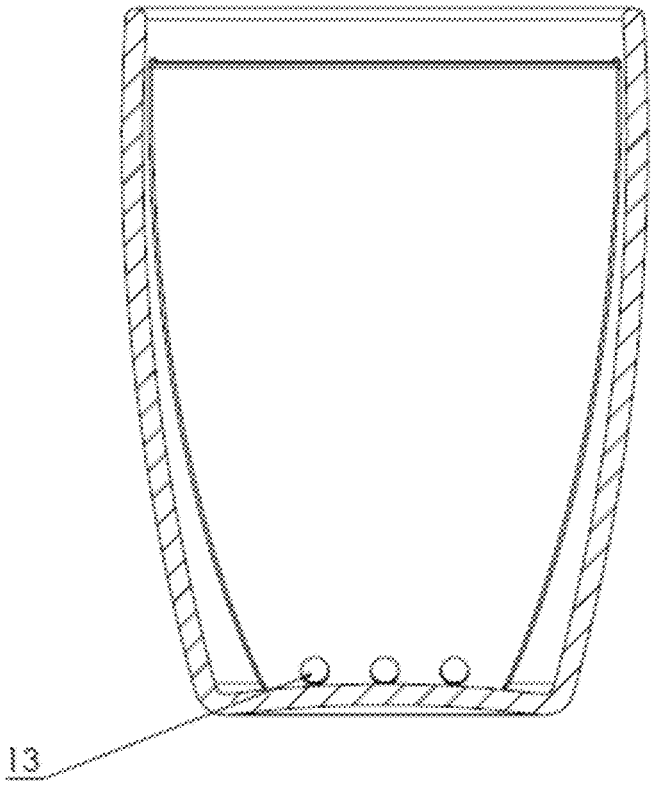
FIGS. 4C-4D show different possible embodiments of a fluid or liquid communicating area arranged in an inner wall of a cup and configured for connecting two compartments of the cup with each other.
Figure 4D:
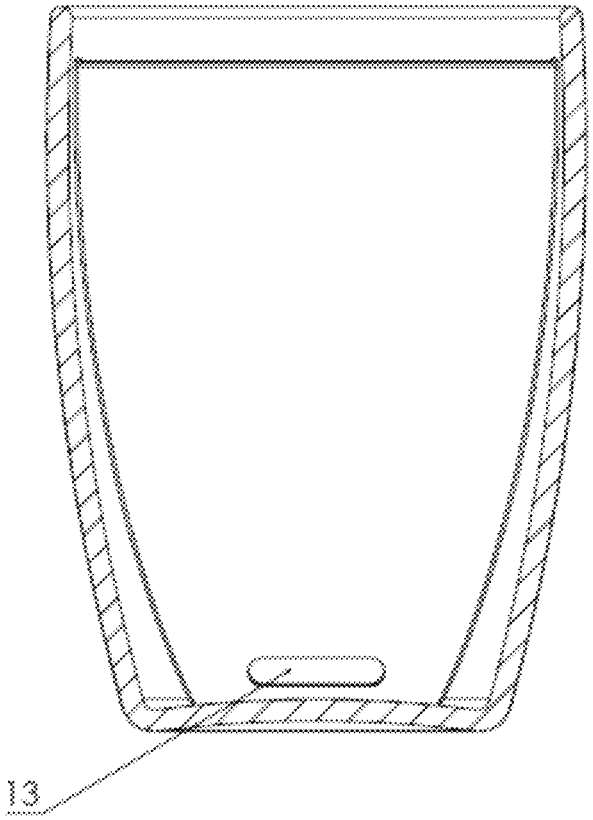

FIGS. 4A (a 3D/perspective view) and 4B (a cross-sectional cut view) show a second embodiment of a cup 10 according to the invention.

Here the inner wall 12 is arranged within the inner or internal area 14, 18 of the cup 10 and is separate from the side wall 11 of the cup 10. The inner wall stretches from the bottom side 16 of the cup 10 mainly to the top side 17 of the cup 10, thus serving as a separating wall for the two compartments 14, 18 within the cup 10. The fluid or liquid communicating area 13 is at least one opening or inlet 13 (see FIG. 4D), wherein in one possible embodiment there can be three openings or inlets 13 (see FIG. 4C). Said at least one opening or inlet 13 can be arranged close to the bottom side 16 area of the cup 10 or at a predetermined height of the inner wall 12 (not shown in the drawings).

Figure 5A:
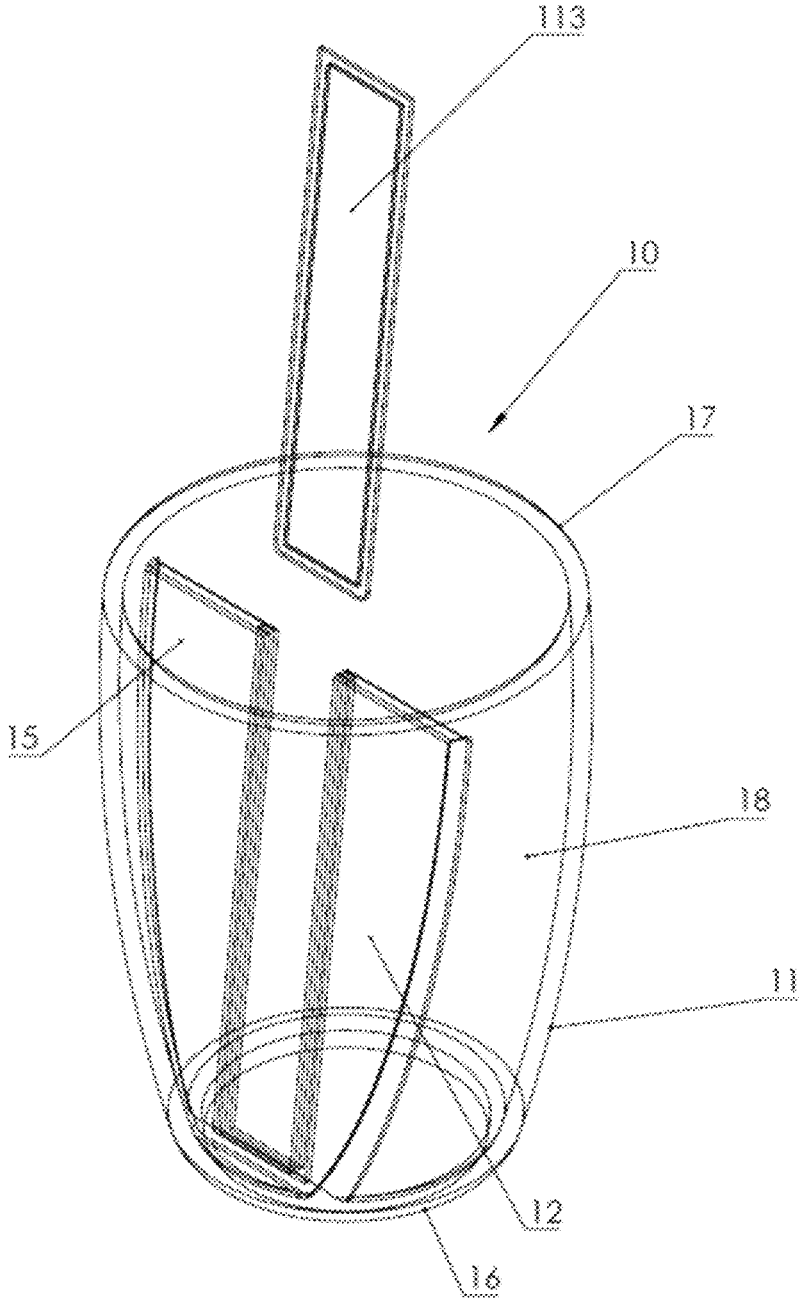
FIGS. 5A-5C show a third embodiment of a cup according to the invention.
Figure 5B:
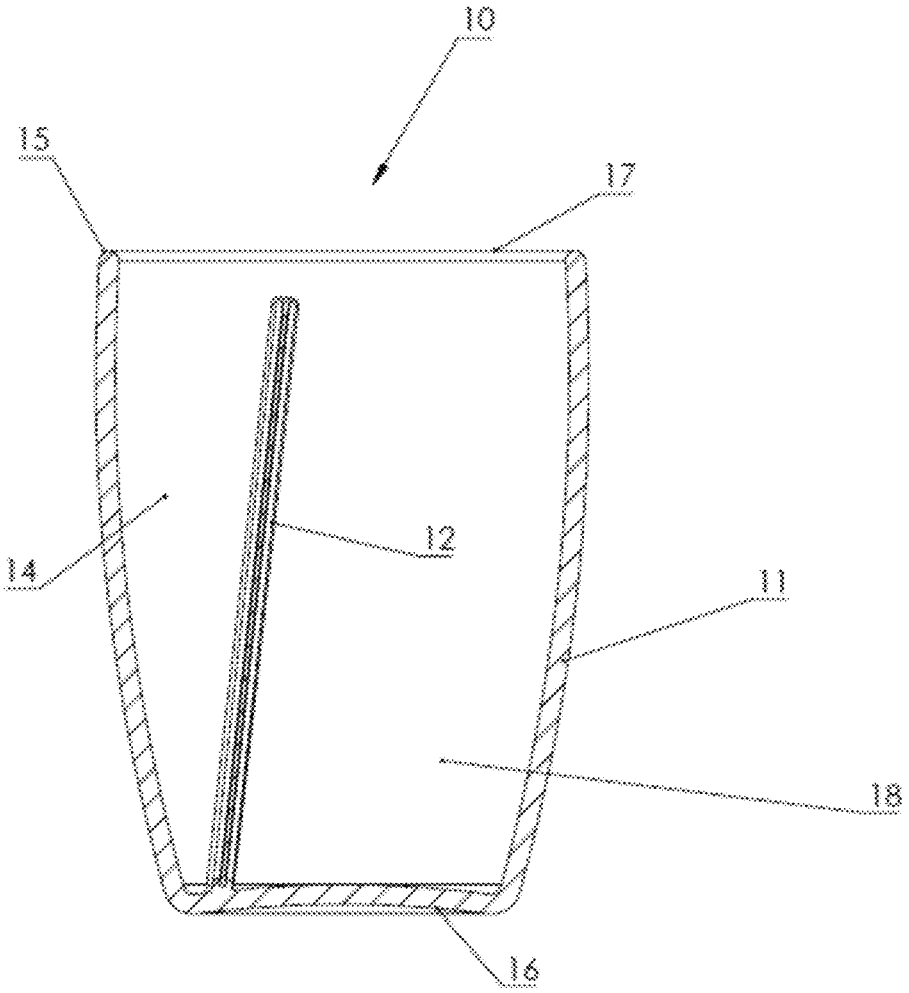

FIGS. 5A (a 3D/perspective view) and 5B (a cross-sectional cut view) illustrate a third embodiment of a cup 10 according to the invention and similar to the second embodiment.

Figure 5C:
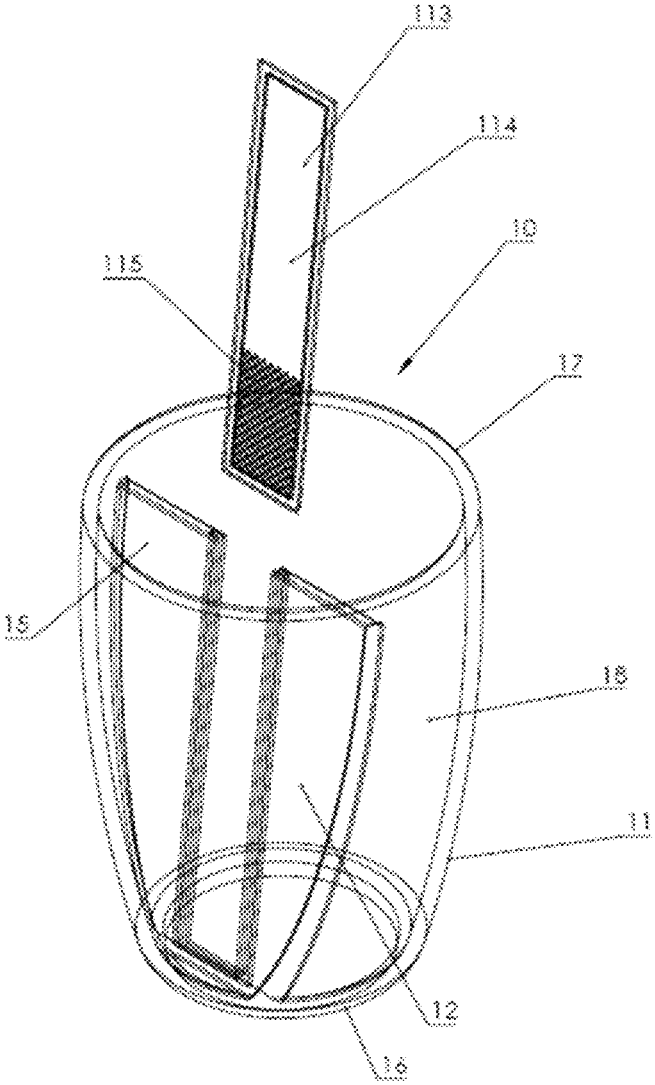

Here the fluid or liquid communicating area is a filter arrangement 113. In a possible embodiment, the inner wall 12 can constitute the filter arrangement 113. The filter arrangement 113 can have a non-filtering or impermeable part 114 and a filtering part 115 having any desired form/shape and arranged in a certain predetermined area of the filter arrangement 113 itself. The filtering part 115 can be arranged in a lower area of the filter arrangement 113 (see FIG. 5C) in order to be close to the bottom 16 of the cup 10 or at a middle height area of the filter arrangement 113. In a possible embodiment, the filter arrangement 113 can be made replaceable or disposable. The replaceable filter arrangement 113 can be for example square-shaped. Further, the replaceable filter arrangement 113 can have on each vertical side a rail or a slot in order to be cooperating with and sliding along a corresponding slot or a rail respectively on each vertical side of the inner wall 12 that separates the two compartments 14, 18. Alternatively, the replaceable filter arrangement 113 can be configured to be pressed or snapped onto a predetermined open area of the inner wall 12 by means of clamp or snap holder(s).

The designs and constructions of the cup 10 embodiments are such that a successful separation of at least one undesired and/or unhealthy drink substance, such as, but not limited to, e.g. coffee fat, diterpenes, cafestol and kahweol, will be achieved.

Additional modifications, alterations and adaptations of the present invention will suggest themselves to those skilled in the art without departing from the scope of the invention as expressed and stated in the following patent claims.

The invention claimed is:

1. A cup for separation of a drink substance contained in a drink, the cup comprising:
- a bottom side;
- an open top side;
- a side wall;
- an inner wall; and
- a liquid communicating area,
- wherein:
- the inner wall is arranged within the cup so as to define a drink containing compartment and a drinking compartment within the cup;
- the drinking compartment includes a drinking area defined at the open top side and arranged adjacent to a part of a top edge of the side wall for allowing a user to drink therefrom;
- the drink containing compartment has access to a part of the open top side for allowing pouring of the drink into the cup;
- the liquid communicating is a filter arrangement which is defined in the inner wall for connecting the drink containing compartment and the drinking compartment together such that the drink substance is kept in the drink containing compartment and is not allowed to enter into the drinking compartment;
- the filter arrangement is replaceable; and
- the filter arrangement is configured to be snapped onto an area of the inner wall.

2. The cup according to claim 1, wherein the liquid communicating area is arranged at or adjacent to the bottom side.

3. The cup according to claim 1, wherein the liquid communicating area is at least one inlet.

4. The cup according to claim 1, wherein the liquid communicating area is at least one opening.

5. The cup according to claim 1, wherein:
- a part of the inner wall constitutes a part of an inner side of the side wall; and
- a part of the drinking compartment is a channel or a chamber integrated in the side wall.

6. The cup according to claim 1, wherein the drinking area is broader or wider than a remainder of the drinking compartment.

7. The cup according to claim 5, wherein the drinking area is broader or wider than a remainder of the drinking compartment.

8. The cup according to claim 1, wherein the drink substance is at least one of coffee fat, diterpenes, cafestol or kahweol.

9. The cup according to claim 1, wherein the filter arrangement comprises an impermeable part and a filtering part.

10. The cup according to claim 9, wherein the filtering part is arranged at or adjacent to the bottom side.

11. A cup for separation of a drink substance contained in a drink, the cup comprising:
- a bottom side;
- an open top side;
- a side wall;
- an inner wall; and
- a liquid communicating area,
- wherein:
- the inner wall is arranged within the cup so as to define a drink containing compartment and a drinking compartment within the cup;
- the drinking compartment includes a drinking area defined at the open top side and arranged adjacent to a part of a top edge of the side wall for allowing a user to drink therefrom;
- the drink containing compartment has access to a part of the open top side for allowing pouring of the drink into the cup;
- the liquid communicating area is a filter arrangement which is defined in the inner wall for connecting the drink containing compartment and the drinking compartment together such that the drink substance is kept in the drink containing compartment and is not allowed to enter into the drinking compartment;
- the filter arrangement is replaceable and square-shaped;
- a longitudinal side of the filter arrangement includes a rail for cooperating or mating with a slot on a longitudinal side of the inner wall, or the longitudinal side of the filter arrangement includes a slot for cooperating or mating with a rail on the longitudinal side of the inner wall; and
- the filter arrangement is configured to be slidably replaced from the open top side.

12. The cup according to claim 11, wherein the liquid communicating area is arranged at or adjacent to the bottom side.

13. The cup according to claim 11, wherein the liquid communicating area is at least one inlet.

14. The cup according to claim 11, wherein the liquid communicating area is at least one opening.

15. The cup according to claim 11, wherein:
- a part of the inner wall constitutes a part of an inner side of the side wall; and
- a part of the drinking compartment is a channel or a chamber integrated in the side wall.

16. The cup according to claim 11, wherein the drinking area is broader or wider than a remainder of the drinking compartment.

17. The cup according to claim 15, wherein the drinking area is broader or wider than a remainder of the drinking compartment.

18. The cup according to claim 11, wherein the drink substance is at least one of coffee fat, diterpenes, cafestol or kahweol.

19. The cup according to claim 11, wherein the filter arrangement comprises an impermeable part and a filtering part.

20. The cup according to claim 19, wherein the filtering part is arranged at or adjacent to the bottom side.

* * * * *